US006772562B1

(12) United States Patent
Dadamo

(10) Patent No.: US 6,772,562 B1
(45) Date of Patent: Aug. 10, 2004

(54) BUILDING PERIMETER FIRE SUPPRESSING SYSTEM

(76) Inventor: Dennis Dadamo, 237 Maple St., Suisun City, CA (US) 94585

( * ) Notice: Subject to any disclaimer, the term of this patent is extended or adjusted under 35 U.S.C. 154(b) by 23 days.

(21) Appl. No.: 10/171,933

(22) Filed: Jun. 17, 2002

(51) Int. Cl.[7] ..... E04H 9/16

(52) U.S. Cl. ..... 52/1; 52/168; 169/16; 169/60; 239/66; 239/68; 239/209; 239/547; 239/565; 137/353; 137/624.12

(58) Field of Search ..... 52/1, 168; 169/5, 169/16–18, 54, 56, 60, 61; 239/66–70, 208, 209, 536, 547, 565; 137/357, 358, 624.12

(56) References Cited

U.S. PATENT DOCUMENTS

| | | | | | |
|---|---|---|---|---|---|
| 2,637,333 | A | * | 5/1953 | Houston, Jr. et al. | |
| 3,583,490 | A | * | 6/1971 | McFadden | 169/13 |
| 4,330,040 | A | * | 5/1982 | Ence et al. | 169/13 |
| 4,372,493 | A | * | 2/1983 | Smith | 239/208 |
| 4,428,434 | A | * | 1/1984 | Gelaude | 169/13 |
| 4,741,361 | A | * | 5/1988 | McHugh | 137/559 |
| 5,036,883 | A | * | 8/1991 | McHugh | 137/559 |
| 5,125,458 | A | * | 6/1992 | Berman | 169/16 |
| 5,165,482 | A | * | 11/1992 | Smagac et al. | 169/45 |
| 5,263,543 | A | * | 11/1993 | Nigro | 169/56 |
| 5,269,344 | A | * | 12/1993 | McHugh | 137/557 |
| 5,692,571 | A | * | 12/1997 | Jackson | 169/16 |
| 5,732,511 | A | * | 3/1998 | Scott | 52/1 |
| 5,931,233 | A | * | 8/1999 | La Bonte et al. | 169/5 |
| 6,079,501 | A | * | 6/2000 | Schmidt | 169/57 |
| 6,109,361 | A | * | 8/2000 | Henderson | 169/54 |
| 6,116,215 | A | * | 9/2000 | Soleanicov et al. | 123/399 |
| 6,167,971 | B1 | * | 1/2001 | Van Lingen | 169/16 |
| 6,186,174 | B1 | * | 2/2001 | Yurchision et al. | 137/625.46 |
| 6,213,149 | B1 | * | 4/2001 | Moner | 137/556.3 |
| 6,263,912 | B1 | * | 7/2001 | Brown et al. | 137/519.5 |
| 6,321,768 | B1 | * | 11/2001 | Taylor | 137/68.12 |
| 6,341,616 | B1 | * | 1/2002 | Taylor | 137/68.12 |
| 6,360,968 | B1 | * | 3/2002 | Orrange et al. | 239/273 |
| 6,450,264 | B1 | * | 9/2002 | Christian | 169/16 |
| 6,523,616 | B1 | * | 2/2003 | Wallace | 169/70 |
| 6,681,802 | B2 | * | 1/2004 | McHugh | 137/613 |
| 6,685,162 | B2 | * | 2/2004 | Carpenter | 251/150 |
| 2003/0029929 | A1 | * | 2/2003 | Rosenberg | 239/99 |

* cited by examiner

*Primary Examiner*—Carl D. Friedman
*Assistant Examiner*—Yvonne M. Horton

(57) ABSTRACT

A building perimeter fire suppressing system for preventing brush and forest fires from engulfing building structure. The building perimeter fire suppressing system includes a water source; and also includes a plurality of pipelines having a plurality of water outlets being spaced therealong and being connected to the water source and being adapted to be disposed underground and on exteriors of building structures; and further includes valve assemblies being attached to the pipelines with each of the valve assemblies including a housing having a respective pipeline being disposed therethrough with a valve member being removably disposed inline of a respective pipeline; and also includes valve actuators being connected to the valve assemblies.

6 Claims, 4 Drawing Sheets

BUILDING PERIMETER FIRE SUPPRESSING SYSTEM

BACKGROUND OF THE INVENTION

1. Field of the Invention

The present invention relates to grounds-protecting fire suppressing systems and more particularly pertains to a new building perimeter fire suppressing system for preventing brush and forest fires from engulfing building structures.

2. Description of the Prior Art

The use of grounds-protecting fire suppressing systems is known in the prior art. More specifically, grounds-protecting fire suppressing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,428,434; U.S. Pat. No. 5,931,233; U.S. Pat. No. 5,165,482; U.S. Pat. No. 4,330,040; U.S. Pat. No. 5,732,511; and U.S. Pat. No. Des. 413,372.

While these devices fulfill their respective, particular objectives and requirements, the aforementioned patents do not disclose a new building perimeter fire suppressing system. The prior art includes complicated fire suppressing systems including computerized control stations.

SUMMARY OF THE INVENTION

The general purpose of the present invention, which will be described subsequently in greater detail, is to provide a new building perimeter fire suppressing system which has many of the advantages of the grounds-protecting fire suppressing systems mentioned heretofore and many novel features that result in a new building perimeter fire suppressing system which is not anticipated, rendered obvious, suggested, or even implied by any of the prior art grounds-protecting fire suppressing systems, either alone or in any combination thereof. The present invention includes a water source; and also includes a plurality of pipelines having a plurality of water outlets being spaced therealong and being connected to the water source and being adapted to be disposed underground and on exteriors of building structures; and further includes valve assemblies being attached to the pipelines with each of the valve assemblies including a housing having a respective pipeline being disposed therethrough with a valve member being removably disposed inline of a respective pipeline; and also includes valve actuators being connected to the valve assemblies. None of the prior art includes the elements of the present invention.

There has thus been outlined, rather broadly, the more important features of the building perimeter fire suppressing system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new building perimeter fire suppressing system which has many of the advantages of the grounds-protecting fire suppressing systems mentioned heretofore and many novel features that result in a new building perimeter fire suppressing system which is not anticipated, rendered obvious, suggested, or even implied by any of the prior art grounds-protecting fire suppressing systems, either alone or in any combination thereof.

Still another object of the present invention is to provide a new building perimeter fire suppressing system for preventing brush and forest fires from engulfing building structures.

Still yet another object of the present invention is to provide a new building perimeter fire suppressing system that is easy and convenient to set up and use.

Even still another object of the present invention is to provide a new building perimeter fire suppressing system that not only saves the buildings but also a lot of money to owners of buildings and to taxpayers and insurance companies alike.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
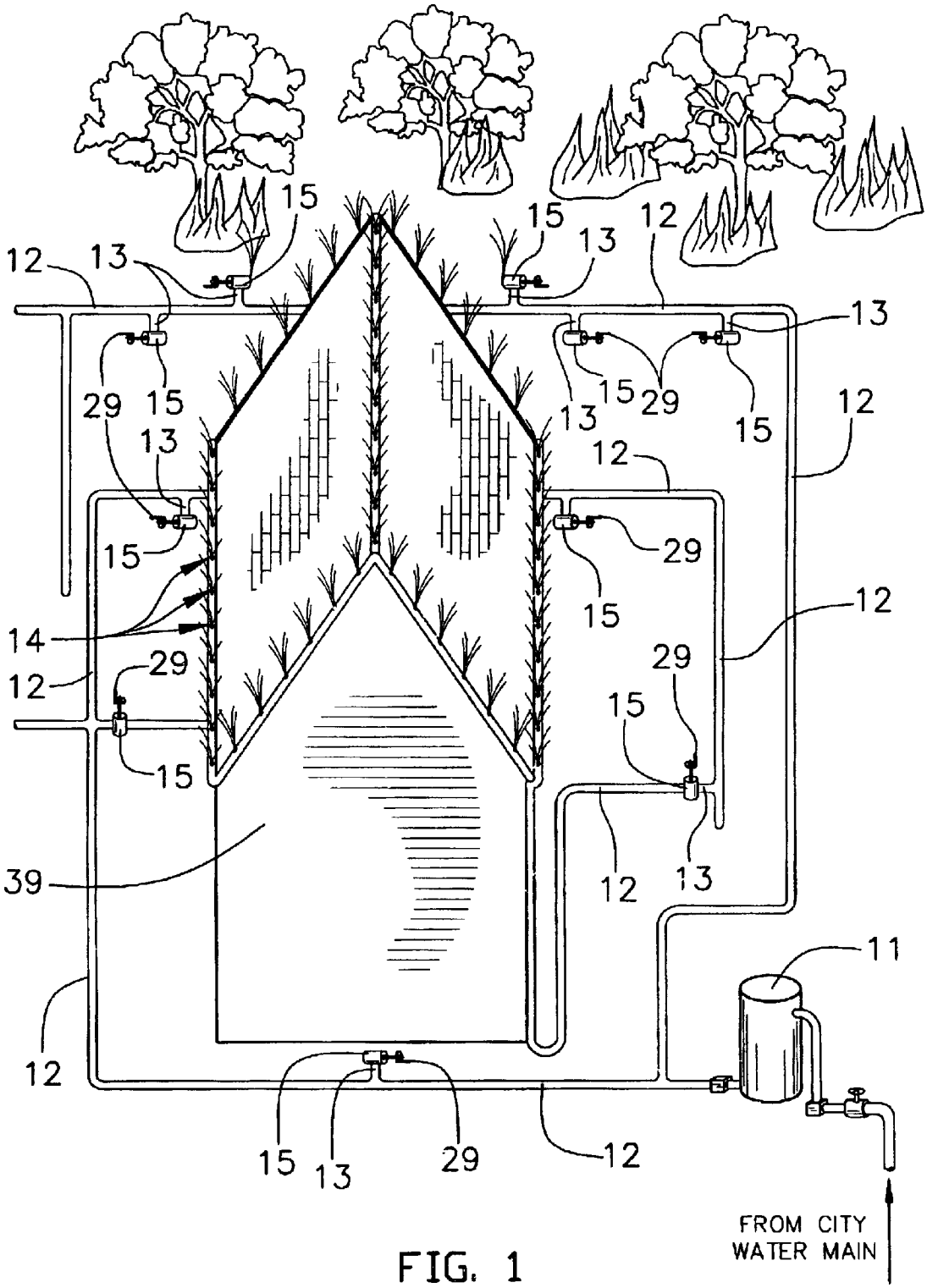
FIG. 1 is a perspective view of a new building perimeter fire suppressing system according to the present invention.
Figure 2:
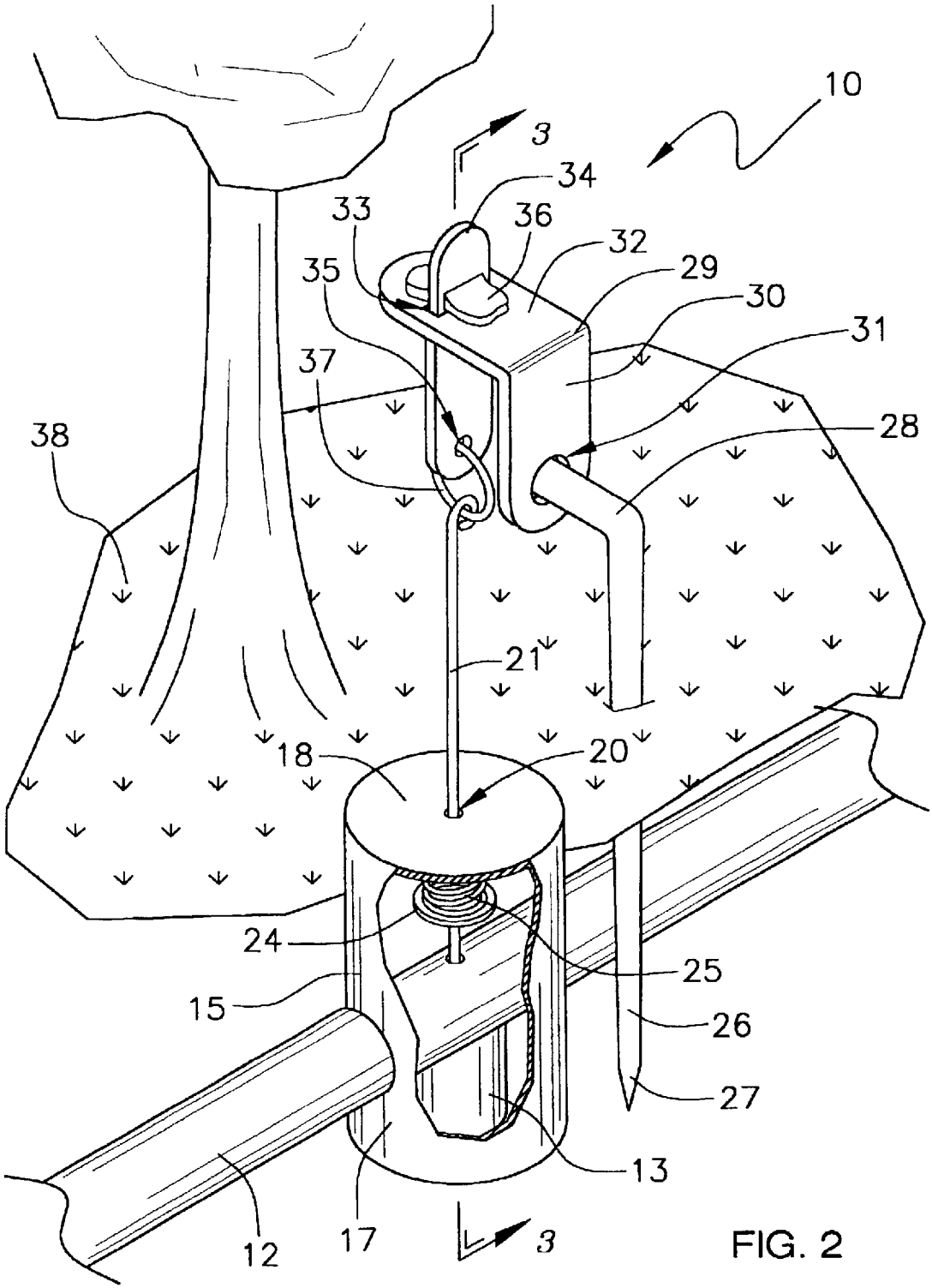
FIG. 2 is a detailed perspective view of a valve assembly of the present invention shown in use.
Figure 3:
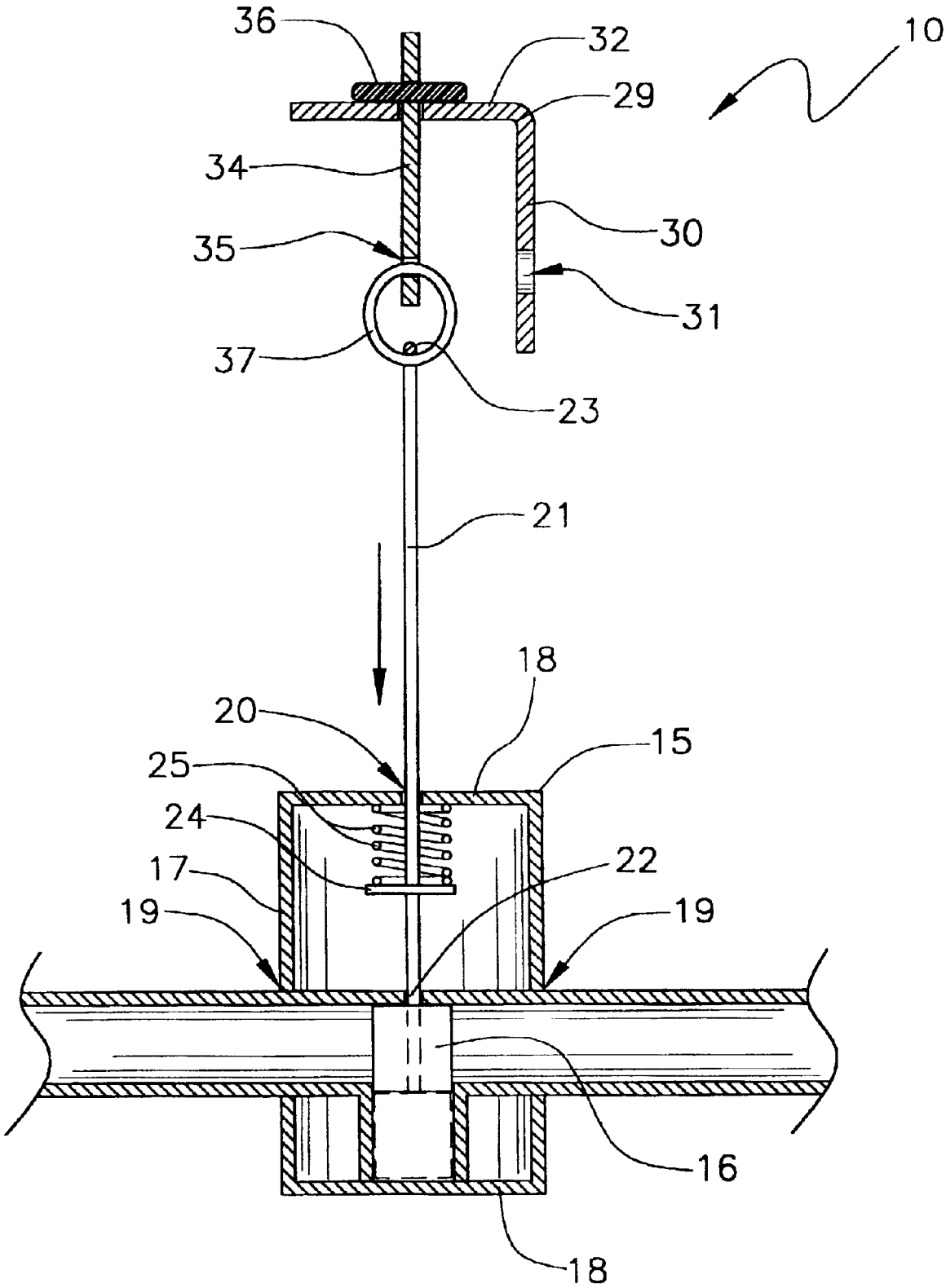
FIG. 3 is a cross-sectional view of a valve assembly of the present invention.
Figure 4:
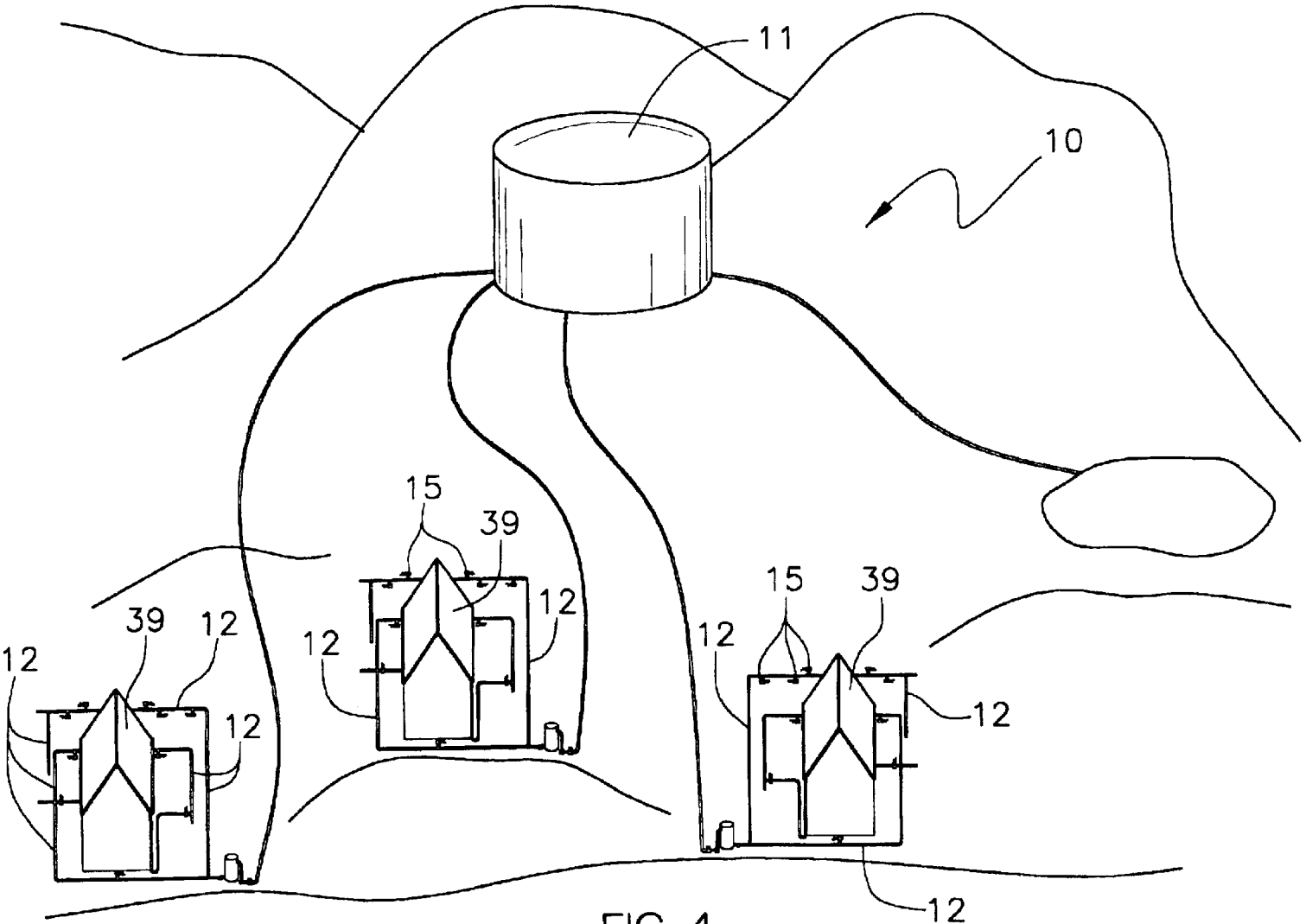
FIG. 4 is a perspective view of the present invention.

With reference now to the drawings, and in particular to FIGS. 1 through 4 thereof, a new building perimeter fire suppressing system embodying the principles and concepts of the present invention and generally designated by the reference numeral 10 will be described.

As best illustrated in FIGS. 1 through 4, the building perimeter fire suppressing system 10 generally comprises a water source 11 such as a reservoir. A plurality of pipelines 12,13 having a plurality of water outlets 14 being spaced therealong are conventionally connected to the water source 11 and are adapted to be disposed underground and on exteriors of building structures 39. The pipelines 12,13 include main pipelines 12, and also include branch members 13 being spaced apart and being in fluid communication with the main pipelines 12.

Valve assemblies are conventionally attached to the pipelines 12,13. Each of the valve assemblies includes a housing 15 having respective pipelines 12,13 being disposed therethrough, and also includes a valve member 16 being removably disposed inline of respective pipelines 12,13. The housing 15 has end and side walls 17,18, and also has diametrically-opposed openings 19 being disposed through the side wall 17 thereof and through which a respective main pipeline 12 is extended, and further has a hole 20 being disposed through one of the end walls 18 thereof with a respective branch member 13 being disposed in the housing 15. The valve member 16 is movable in and between a respective main pipeline 12 and a respective branch member 13, and is generally a plug. Each of the valve assemblies further includes an elongate valve support member 21 being movable through a hole in a respective main pipeline 12 and having a first end 22 which is securely and conventionally attached to the valve member 16 and also having a second end 23 and being movable through the hole 20 in the housing 15, and also includes a block member 24 being conventionally attached about the elongate valve support member 21 in the housing 15, and further includes a spring member 25 being disposed about the elongate valve support member 21 and being disposed between one of the end walls 18 of the housing 15 and the block member 24 for moving the valve member 16 from in a respective main pipeline 12 into a respective branch member 13.

Valve actuators are conventionally connected to the valve assemblies. Each of the valve actuators includes an anchor member 26 being adapted to be securely attached to a building structure 39 and to a ground 38, and also includes a bracket member 29 being mounted to the anchor member 26, and further includes a linkage member 34 being releaseably held to the bracket member 29 and being conventionally connected to the elongate valve support member 21, and also includes a heat sensitive linkage-releasing coupling member 36 being conventionally attached to the linkage member 34 and to the bracket member 29. The anchor member 26 is a stake having a ground-penetrating portion 27, and also having an end portion 28 which is angled relative to the ground-penetrating portion 27. The bracket member 29 includes a first portion 30 having a hole 31 being disposed therethrough and through which the end portion 28 of the anchor member 26 is disposed, and also includes a second portion 32 having laterally-extending slot 33 being disposed therethrough. The linkage member 34 is an elongate plate which is releaseably retained through the laterally-extending slot 33 and which has a hole 35 being disposed therethrough near an end thereof. The heat sensitive linkage-retaining/releasing coupling member 36 is generally made of a conventional thermal-decoupling material. Each of the valve actuators further includes a ring member 37 being conventionally connected to the second end 23 of the elongate valve support member 21 and being disposed through the hole 35 in the linkage member 34.

In use, forest or brush fires encroaching upon a user's property would melt down the heat sensitive linkage-retaining/releasing coupling members 36 which would release the linkage members 34 from the bracket members 29 with the spring members 25 urging the elongate valve support members 21 into the housings 15 with the valve members being moved from the main pipelines 12 into the branch member 13 thus opening the main pipelines 12 to allow water from the water source 11 to be discharged through the water outlets 14 in the pipelines 12 to douse the fire as it approaches the user's building structure 39.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the building perimeter fire suppressing system. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A building perimeter fire suppressing system comprising:

a water source;

a plurality of pipelines having a plurality of water outlets being spaced therealong and being connected to said water source and being adapted to be disposed underground and on exteriors of building structures, said pipelines including main pipelines, and also including branch members being spaced apart and being in fluid communication with said main pipelines;

valve assemblies being attached to said pipelines, each of said valve assemblies including a housing having respective said pipelines being disposed therethrough, and also including a valve member being removably disposed inline of respective said pipelines, said housing has having end and side walls, and also has having diametrically-opposed openings being disposed through said side wall thereof and through which a respective said main pipeline is extended, and further has having a hole being disposed through one of said end walls thereof with a respective said branch member being disposed in said housing, said valve member being movable in and between a respective said main pipeline and a respective said branch member, and is generally a plug, each of said valve assemblies further including an elongate valve support member being movable through a hole in a respective said main pipeline and having a first end which is securely attached to said valve member and also having a second end and being movable through said hole in said housing, and also including a block member being attached about said elongate valve support member in said housing, and further including a spring member being disposed about said elongate valve support member and being disposed between one of said end walls of said housing and said block member for moving said valve member from in a respective said main pipeline into a respective said branch member; and valve actuators being connected to said valve assemblies, each of said valve actuators including an anchor member being adapted to be securely attached to a building structure and to a ground, and also including a bracket member being mounted to said anchor member, and further including a linkage member being releaseably held to said bracket member and being connected to said elongate valve support member, and also including a heat sensitive linkage-releasing coupling member being attached to said linkage member and to said bracket member.

2. A building perimeter fire suppressing system as described in claim 1, wherein said anchor member is a stake having a ground-penetrating portion, and also having an end portion which is angled relative to said ground-penetrating portion.

3. A building perimeter fire suppressing system as described in claim 2, wherein said bracket member includes a first portion having a hole being disposed therethrough and through which said end portion of said anchor member is disposed, and also includes a second portion having laterally-extending slot being disposed therethrough.

4. A building perimeter fire suppressing system as described in claim 3, wherein said linkage member is an elongate plate which is releaseably retained through said laterally-extending slot and which has a hole being disposed therethrough near an end thereof.

5. A building perimeter fire suppressing system as described in claim 4, wherein said heat sensitive linkage-retaining/releasing coupling member is generally made of a thermal-decoupling material.

6. A building perimeter fire suppressing system as described in claim 5, wherein each of said valve actuators further includes a ring member being connected to said second end of said elongate valve support member and being disposed through said hole in said linkage member.

* * * * *